United States Patent [19]

Price et al.

[11] Patent Number: 4,598,184

[45] Date of Patent: Jul. 1, 1986

[54] THREAD TENSION MONITORING AND CLAMPING APPARATUS

[75] Inventors: Gordon L. Price, Fairfax, Ala.; Howard G. Ruddick, West Point; Henry R. Cook, LaGrange, both of Ga.

[73] Assignee: West Point Foundry and Machine Co., West Point, Ga.

[21] Appl. No.: 723,888

[22] Filed: Apr. 16, 1985

[51] Int. Cl.[4] ..... B65H 49/00

[52] U.S. Cl. ..... 200/61.18; 242/131.1

[58] Field of Search ..... 200/61.13, 61.14, 61.15, 200/61.16, 61.17, 61.18; 340/675, 677; 242/131.1

[56] References Cited

U.S. PATENT DOCUMENTS

| | | | |
|---|---|---|---|
| 1,816,765 | 7/1931 | Crawford | 279/95 |
| 3,096,945 | 7/1963 | Wildi | 242/19 |
| 3,438,188 | 4/1969 | Boggs | 67/81 |
| 3,873,043 | 3/1975 | Wildi et al. | 200/61.18 X |
| 3,930,291 | 1/1976 | Abbott | 242/36 X |
| 4,075,744 | 2/1978 | Mista et al. | 28/224 |
| 4,078,372 | 3/1978 | Stahlecker | 67/81 |

*Primary Examiner*—A. D. Pellinen
*Assistant Examiner*—Morris Ginsburg
*Attorney, Agent, or Firm*—Jones & Askew

[57] ABSTRACT

Apparatus for monitoring the tension of a thread in a warp beaming operation, and for selectably clamping that thread to maintain tension in the thread. A drop wire is pivotably mounted alongside a thread guide region, and a thread clamping member is located adjacent the thread guide region. The drop wire includes a thread retaining member normally positioned to keep a thread in the thread guide region, and also includes a deflecting member which pivotably displaces the drop wire assembly to permit placing a thread into the thread guide region. A substantially straight-line path for loading the inbound thread into the thread guide region thus is provided.

12 Claims, 5 Drawing Figures

THREAD TENSION MONITORING AND CLAMPING APPARATUS

FIELD OF THE INVENTION

This invention relates in general to apparatus for monitoring the tension of a thread or yarn traveling along a path and for selectably clamping the thread, and relates in particular to such apparatus for use with thread creels or the like.

BACKGROUND OF THE INVENTION

Warps or sheetlike rolls of threads are prepared by drawing many separate threads from individual packages of thread and winding the threads on a central core, a process known as warping or beaming. These thread packages typically are mounted on a creel, a structure which supports the thread packages while the thread ends are drawn from the thread packages to the warp beam.

Before starting the warp beaming operation, it is necessary to maintain a degree of tension in the threads being drawn from the creel by the warp beaming apparatus. This thread tension prevents adjacent threads from contacting each other and tangling, and promotes even winding of the warp beam. The unwinding friction imparted as the thread is pulled from the thread package, and the air friction acting on the thread while running at high beaming speeds, normally maintain adequate tension in the thread when the warp beaming operation is underway. When the operator is initially drawing the threads from the creel to the warper, and while the warper is running at relatively slow startup speeds, some additional source of thread tension is usually needed to keep the threads from going slack. For this purpose, a thread creel usually includes some kind of thread tensioning or clamping device for each thread package supported by the creel. These thread clamps, frequently located in close proximity to tension monitoring apparatus for the threads, can selectably engage each individual thread being withdrawn from the creel and maintain predetermined tension in the threads on the creel as the warping operation is starting, or while a broken thread end is being repaired. These thread clamping devices also maintain thread tension at the individual yarn packages while the warper is topped, preventing tangling between individual threads.

If a thread breaks or loses adequate tension for any reason, the warping operation will be interrupted while an operator repairs the broken thread or other problem. The tension in each thread being withdrawn from the creel thus must be monitored with some appropriate mechanism or device, because detecting thread breakage by visual inspection is impractical due to the large number of thread packages on a typical creel and the operating speed of the warp beaming apparatus.

Devices for monitoring thread tension and for selectably clamping the thread are known in the art, one such device being disclosed in U.S. Pat. No. 3,873,043. Prior-art thread monitoring and clamping devices in general have been less than satisfactory. Such devices typically include a hook or similar thread-engaging member which retains the running thread in the tension monitoring device, and the device thus defines a twisted or tortuous path for inserting the thread around the tension thread engaging member. While the time or effort required to insert an individual thread into its corresponding tension sensing device may not seem particularly large, a typical creel carries several hundred thread ends which must be individually threaded through a corresponding number of individual tension assemblies. Thus, the cumulative additional time required by the creel operator to individually insert several hundred threads into corresponding tension assemblies becomes a significant factor in the down time of a creel. Furthermore, a thread tension monitoring device having a twisted or other non-straightline path for inserting the thread presents the possibility of misthreading by the operator, in which case even more time is required to correct that mistake.

SUMMARY OF THE INVENTION

Stated in general terms, thread tension monitoring apparatus according to the present invention includes structure defining a thread guide region alongside the travel path for the thread. The apparatus also defines a thread entry path leading into the thread guide region, and this thread entry path preferably is substantially straight to facilitate easy and rapid insertion of the thread into that region. A sensing member crosses the path of thread travel in the thread guide region and contacts the thread to detect breakage or insufficient tension of the thread.

The sensing member of the present apparatus includes an element which normally extends across the thread entry path and obstructs that entry path, so as to prevent dislocation of a thread previously disposed in the thread guide region. However, the apparatus includes a deflecting member mounted for contact by a thread being introduced to the guide region through the thread entry path. This deflecting member displaces the obstructing member as the thread is being drawn through the straightline thread entry path, so that the thread is easily and readily introduced to the thread guide region in a substantially straight movement.

Stated somewhat more specifically, the present tension monitoring apparatus includes a thread guide forming an open throat region and at least partially defining the straight thread entry path to the thread guide region. The thread tension sensing member is biased to move across the path traveled by the thread running from the creel to the warper, placing the obstructing member to block the thread entry path. The deflecting member also extends across the thread entry path, in position for contact by a thread being directed therealong by the thread guide member. In a particular embodiment of the invention, the deflecting member is angularly disposed across the thread entry path and pivots to partially displace the obstructing member as the thread contacts and displaces the deflecting member. A movable thread clamping member is disposed on one side of the thread guide region and preferably is shielded by a cover member when the clamping member is open, thereby not interfering with the normal movement of thread into the guide region through the thread entry path.

Stated with more particularity, the thread sensing member includes a thread-contacting trip wire pivotably mounted for movement along an arc intersecting the path of thread travel through the guide region. This trip wire includes a thread contacting portion, and the trip wire is biased to move the thread contacting portion across the thread guide region adjacent the confronting thread clamp. The trip wire is bent to form the obstructing member crossing the thread travel path and preventing the thread from escaping that path, and a knee-shaped angled portion of the wire joins the obstructing member to the deflecting member which moves the obstructing member and permits thread entry into the thread guide region. The thread clamping member is opened and closed by a cam-actuated operating pin which extends across the thread travel path, the pin defining one side of the thread guide region.

Accordingly, it is an object of the present invention to provide an improved thread tension monitoring apparatus.

It is another object of the present invention to provide an improved apparatus for monitoring thread tension and for selectably clamping the thread.

It is a further object of the present invention to provide a thread tension monitoring apparatus having a substantially straight path for inserting a thread into the apparatus.

It is still another object of the present invention to provide a thread tension monitor with a tension sensing member normally biased across a straightline thread introduction path, and which blocks withdrawal of a thread previously introduced to that path.

DESCRIPTION OF PREFERRED EMBODIMENT

Figure 1:
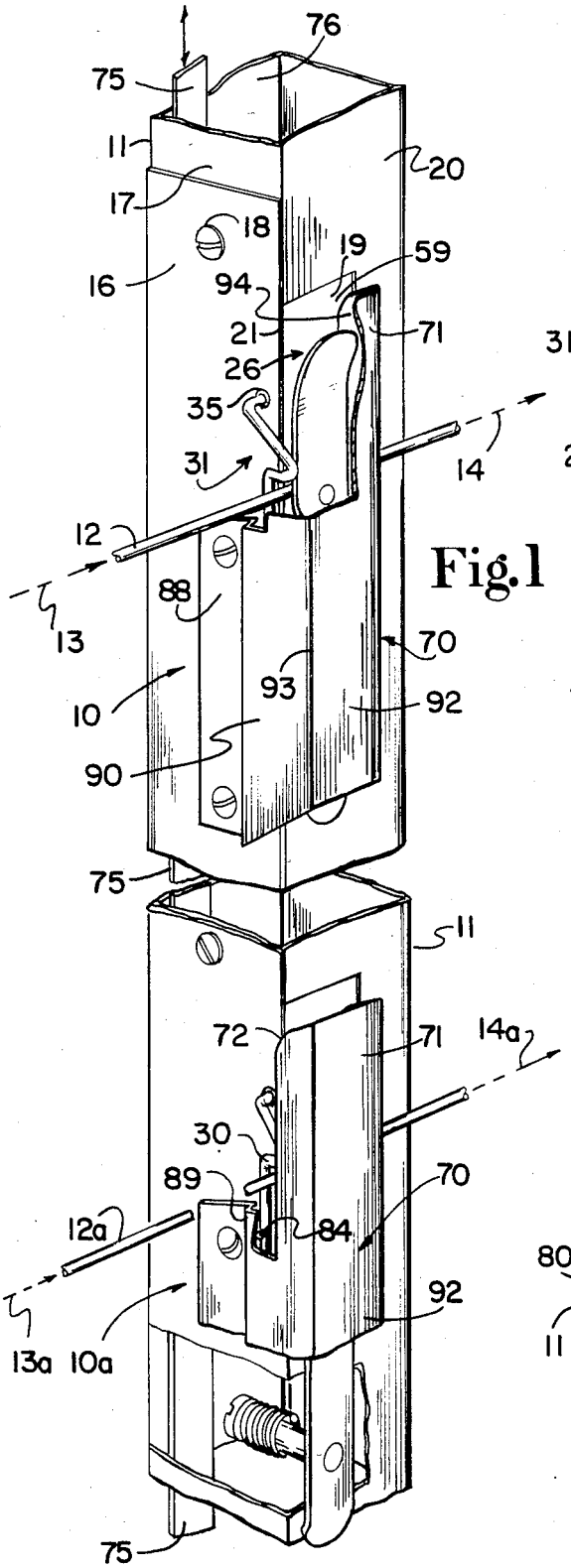
FIG. 1 is a pictorial view, partly broken away for illustrative purposes, showing two similar thread tension monitoring and clamping devices according to a preferred embodiment of the present invention.

Turning first to FIG. 1, there are shown generally at 10 and 10A two separate and identical tension monitoring and clamping assemblies according to a preferred embodiment of the present invention. Those assemblies 10 and 10A are mounted on the upright post 11, which forms part of a typical creel (not shown) and is located adjacent a vertical row of thread package holders on the creel. Those skilled in the art will realize that the typical creel has a separate tension and clamping assembly 10 for each individual thread package holder on the creel, and that the tension and clamping assemblies for a particular vertical row of thread package holders are mounted on a single post 11 or the like. The two assemblies 10 and 10A are shown in FIG. 1 associated with threads 12 and 12*a*, traveling along thread paths 13 and 13*a*, extending back to two separate thread packages (not shown) carried on a creel. Moreover, the threads 12 and 12*a* travel along paths 14 and 14*a* toward the warp beaming apparatus (also not shown).

Each assembly 10 and 10A preferably is removably attached to the post 11, for ease of servicing and the like. To that end, each assembly includes a face plate 16 which lies against one side 17 of the post 11 and is secured to the post by one or more fasteners such as the bolt 18 or the like. The vertical edge 21 of the face plate 16 is contiguous with a corner of the post 11 and the face plate is attached, as by welding or the like, to the inner plate 19, which lies against the corresponding side 20 of the post. Portions of the post sides 17 and 20 disposed beneath the face plate 16 and inner plate 19 are cut away (not shown) to receive operating components of the tension and a clamp assembly 10, as detailed below.

Figure 3:
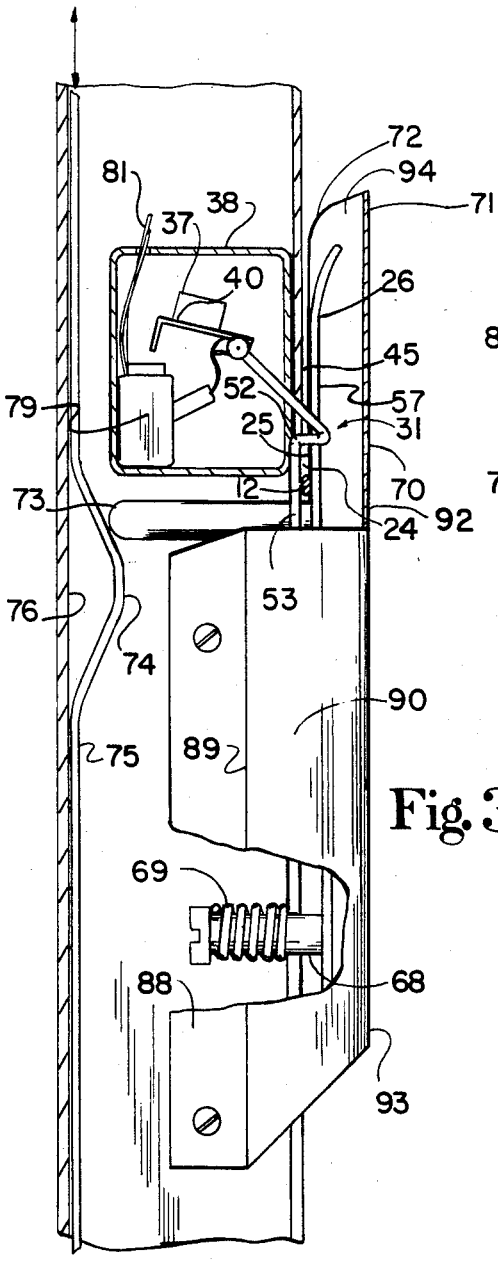
FIG. 3 is a side section view showing a thread monitoring and clamping device in FIG. 1, with the clamp engaging the thread.
Figure 4:
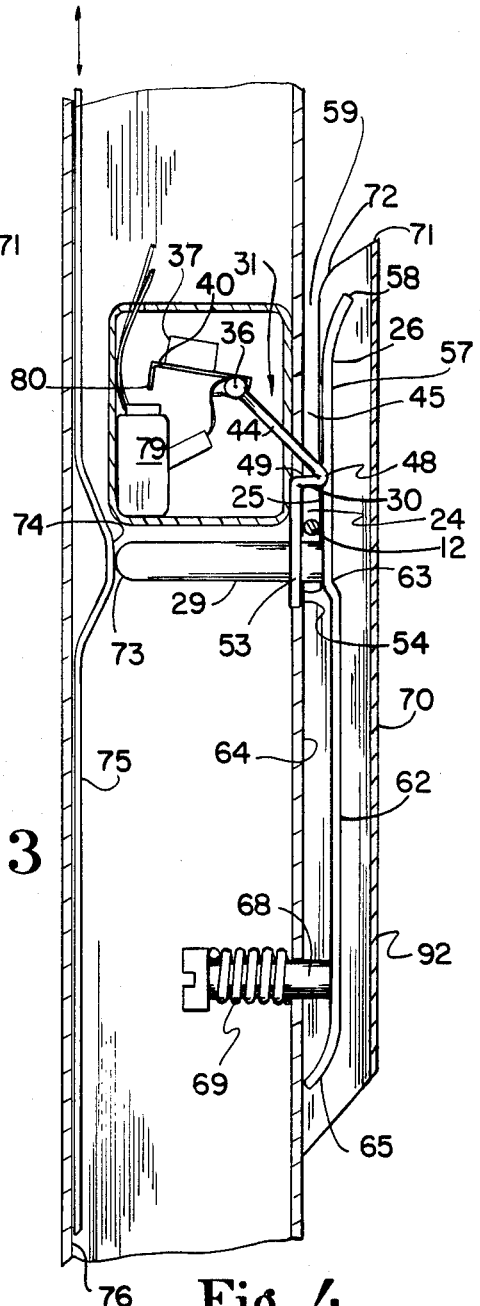
FIG. 4 is a view as in FIG. 3, with the clamp in open position.

The outer face of the inner plate 19 forms one side of a thread guide region 24, best seen in FIGS. 3 and 4, which receives and retains the thread 12 running through the assembly 10. Facing the inner plate 19 in confronting spaced-apart relation, and forming an opposite side of the thread guide region 24, is the thread engaging region 25 of the thread clamp 26. The lower side of the thread guide region 24 is bounded by the top of the cylindrical clamp actuating pin 29, and the upper side of that region is defined by the thread retaining surface 30 of the drop wire 31 which comprises the thread sensing member.

Because the threads 12 typically are drawn through the thread guide region 24 at a substantial linear velocity during a warp beaming operation, the component surfaces making up the thread guide region 24 preferably are coated or fabricated of material having a low coefficient of sliding friction and a relatively high resistance to abrasive wear. For example, thread contacting portions of the inner plate 19, the thread engaging region 25 of the thread clamp 26, and the clamp actuating pin 29 may be chrome-plated for desired hardness. The thread sensing member 53 at the free end of the drop wire 31 is normally biased to contact the running thread 12 as pointed out below, and that member preferably has a hardened surface such as hard chromium plating or the like for resistance to abrasion. These friction and abrasion reducing practices not only reduce the likelihood of fraying or otherwise damaging the running thread 12 passing through the tension and clamp assembly, but also reduce frictional wear on the thread-engaging components of the assembly.

Figure 2:
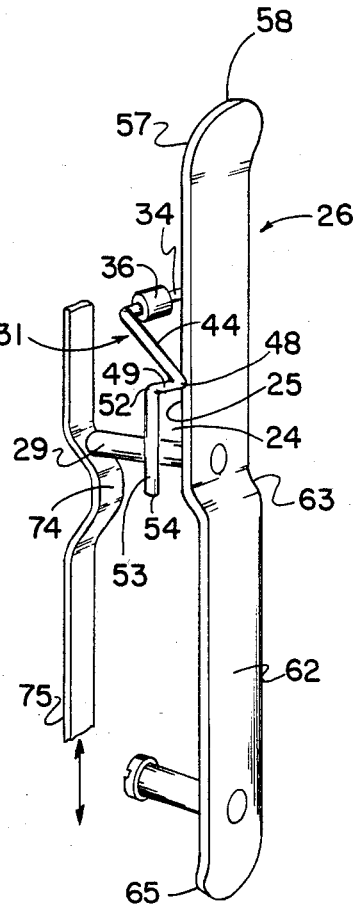
FIG. 2 is a skeletal pictorial view showing operative elements of the disclosed embodiment, separated from the mounting post and related structure of FIG. 1.

The drop wire 31 is located on the outside of the face plate 16, and is pivotably mounted so that the thread sensing member 53 moves on a plane transverse to the thread path 13. As best seen in FIGS. 1 and 2, the drop wire 31 includes a shaft 34 extending inwardly through the opening 35 in the face plate 16. This shaft 34 is suitably journalled by the bearing 36 located within the hollow post 11, so that the drop wire shaft 34 can undergo pivotable movement on its axis. A counterweight 37 (FIGS. 3–5) is attached by welding or the like to the contact arm 40 which extends radially out from the drop wire shaft 34. The contact arm 40 thus is urged downwardly, as seen in FIGS. 3 and 4, by the counterweight 37, biasing the drop wire 31 to pivot in the counterclockwise direction as viewed in those figures.

The drop wire 31 undergoes a right-angle bend immediately outside the opening 35 in the face plate 16, and from that bend extends diagonally down and forward to form the deflecting member 44. This deflecting member 44 occupies a plane immediately to the left side of the thread clamp 26, permitting the deflecting member to undergo pivotable movement in that plane without binding on the thread clamp. As best seen in FIGS. 3 and 4, the deflecting member 44 of the drop wire 31 extends across the narrow gap or slot 45 defined between the confronting surfaces of the thread clamp 26 and the inner plate 19. This slot 45, as pointed out below, defines the thread entry path for inserting a thread 12 into the thread guide region 24 located below the deflecting member 44.

The outermost end of the deflecting member 44 is defined by the knee-shaped bend 48, where the drop wire folds back to form the thread retaining member 49. As best seen in FIGS. 3 and 4, the deflecting member 44 and the thread retaining member 49 form two sides of an acute angle having the bend 48 as its apex. The lower side of the thread retaining member 49 provides the thread retaining surface 30 forming the upper bound of the thread guide region 24, as previously discussed. The length of the thread retaining member 49 is at least equal to the width of the thread entry slot 45, and preferably is slightly greater than the width of that slot. The thread retaining member 49 is a straight segment of the rod-like drop wire 31 in the disclosed embodiment, although other configurations of the thread retaining member are within the scope of the present invention.

The left or inner end of the thread retaining member 49 is defined by another right-angle bend 52 in the drop wire 31. Extending downwardly from the bend 52 is a straight portion 53 of the drop wire, comprising the thread sensing member of the tension and clamp assembly. From the bend 52, the thread sensing member 53 extends downwardly to its free end 54 located a short distance below the clamp actuating pin 29. As previously mentioned, at least the portions of the drop wire 31 regularly contacted by the running thread 12 preferably are chromium plated or are otherwise treated to resist frictional wear and abrasion. These plated portions of the drop wire 31 thus include the thread sensing member 53, and may also include the thread retaining member 49 and the deflecting member 44.

The thread clamp 26 is a substantially flat elongated member having a straight thread clamping section 57 along its upper half, and terminating at the upper end 58 bent outwardly to form an enlarged throat area 59 leading to the thread entry slot 45. The clamp actuating pin 29 is attached at one end to the post-facing side of the thread clamp 26 at the lower end of the thread clamping section 57. A joggle 63 in the thread clamp 26, immediately below the clamp actuating pin 29, spaces the lower section 62 of the thread clamp outwardly from the confronting face 64 of the post 11, as best seen in FIG. 4. The lower end 65 of the thread clamp 26 is bent inwardly to contact the posts face 64. A stud 68 is secured to the lower section 62 a short distance above the curved lower end 65, and this stud freely extends through an aligned opening in the face 64 of the post 11. A compression spring 69 surrounds the stud on the inside of the post 11 and draws the stud inwardly toward the post. The curved lower end 65 of the thread clamp 26, in contact with the face 64 of the post 11, thus acts as a fulcrum around which the upper extent of the thread clamp is pivotably drawn toward the inner plate 19 by the force of the compression spring 69.

The clamp actuating pin 29 terminates at its free end 73 within the hollow post 11. The end 73 of the clamp actuating pin 29 is rounded to form a cam engaging surface, in close proximity to the raised cam surface 74 formed on the cam bar 75. The cam bar 75 is slidably movable along the back side 76 of the post 11, and the cam baar extends substantially the full vertical extent of the post. It will be understood that the cam bar 75 has cam surfaces 74 formed at periodic intervals corresponding to the locations of the several tension and clamp assemblies 10 located on the post 11.

The cam bar 75 is selectably vertically movable either to the thread clamping position shown in FIG. 3, or to the clamp open position shown in FIG. 4. In the thread clamping position, the free end 73 of the clamp actuating pin 29 is on a lower portion of the cam surface 74, or may alternatively be entirely out of contact with the cam surface. The force of the compression spring 69 acting on the thread clamp 26 thus moves the thread clamping section 57 of the thread clamp into engagement with the confronting face of the inner plate 19, frictionally engaging any thread 12 located in the thread guide region 24. However, when the cam bar 75 is moved to the clamp-open position shown in FIG. 4, the cam surface 74 pushes the clamp actuating pin outwardly, rocking the thread clamp 26 about the fulcrum provided by the lower end 65 of the thread clamp. The thread clamping section 57 thus is moved away from the confronting face of the inner plate 19, and out of clamping engagement with a thread 12 in the thread guide region 24. The cam bar for each post 11 can be selectably raised or lowered by a motorized drive mounted at the upper ends of the several posts associated with the creel. Such drives are known in the art and form no part of the present invention.

The angular position of the drop wire 31 is sensed by an electrical switching device 79 located within the enclosure 38, inside the post 11. The switching device 79 is actuated when engaged by the contact 80 at the outer end of the contact arm 40, completing an electrical circuit including the electrical lead 81 which can be connected to control apparatus operative to interrupt the operation of the warp beaming equipment. This electrical control connection is well-known to those skilled in the art, and is not discussed further herein. The switching device 79 can be a simple electrical contact which, when grounded by engagement with the contact 80 at the end of the contact arm 40, closes the appropriate control circuit. Alternatively, the electrical switching device 79 may be a noncontact switch such as a photodetector or a Hall-type switch, both of which are known to those skilled in the art. It will be understood that the electrical leads 81 of all assemblies 10 associated with a creel will be operatively interconnected so that a sensed break of any thread will stop the warp beaming operation.

The movable thread clamp 26 is surrounded on three sides by the cover 70. This cover has a mounting panel 88 affixed to the face plate 16, the upper edge of the mounting panel being located below the lower extent of the thread guide region 24 as shown in FIG. 3. The cover 70 jogs out at 89 from the mounting panel 88 to form the side cover 90 enclosing the free end 54 of the thread sensing member 53. The side cover 90 is laterally spaced apart from the thread sensing member 53 and from the thread clamp 26.

The cover 70 includes a clamp cover 92 enclosing at least the upper portion of the thread clamp 26. The clamp cover 92 joins the side cover 90 along the right-angle bend 93, and wraps around the clamp 26 as shown at 94 to cover the other side of the clamp. The upper end 71 of the clamp cover 92 has sufficient clearance outwardly from the confronting surface of the inner plate 19 to accommodate movement of the thread clamp in response to actuation of the cam bar 75. The upper end 71 of the cover 70 has the cross-section shape of a U whose open end confronts the inner plate 19, as best seen in FIGS. 1 and 4, and the inwardly-facing edges 72 of the cover curve inwardly from the upper end 71 to help define the throat region 45 leading downwardly to the thread guide region 24. As best seen in FIG. 4, the upper end 58 and the thread clamping section 57 of the thread clamp are recessed within the U-shape at the upper end 71 of the cover 70, when the thread clamp is open.

The operation of the disclosed tension and clamp assembly is now described with respect to one such assembly. Assuming at the outset that no thread is in the thread engaging region 25, the drop wire 31 assumes the solid-line position shown in FIG. 5. In that position, the counterweight 37 urges the drop wire 31 to its fully-extended position placing the thread sensing member 53 across the thread guide region 24. In this fully-pivoted position of the drop wire, the contact 80 at the end of the contact arm 40 engages the switching device 79.

To thread the assembly 10, a thread 12 from the creel (not shown) is held above the open throat 59 and is moved downwardly along the straight thread entry path 45 between the inner plate 19 and the confronting facing edges 72 of the cover 70. The cam bar 75 is operated to place the thread clamping section 57 in the open position shown in FIGS. 4 and 5 at this time, placing the upper end 58 of the thread clamping section behind the cover edges 72. With the upper end 58 thus positioned behind the edges 72, the thread 12 being inserted in the throat 59 cannot inadvertently snag or hook behind the upper end of the thread clamping section.

The inbound thread 12 now is moved downwardly through the thread entry slot 45 to contact the deflecting member 44 of the drop wire 31. The downward movement of the thread against the diagonal deflecting member 44 displaces the drop wire 31 in a clockwise direction as viewed in FIG. 5, pivoting the drop wire toward the phantom position shown in that figure. The inbound thread thus manually displaces the drop wire from its normal thread-engaging position, allowing the thread to move around the knee bend 48 and pass below the thread retaining member 49 of the drop wire thereby entering the thread engaging region 25.

When the thread 12 is manually moved below the thread retaining member 49, the counterweight 37 returns the drop wire 31 to the position shown in FIG. 4. The thread retaining member 49 remains above the thread, preventing the thread from laterally exiting the thread guide region 24, and the tension assembly 10 now is threaded.

The foregoing threading operation is repeated for each tension and clamping assembly 10 associated with an active thread on the corresponding creel. When all threads are inserted in the tension and clamping assemblies, the cam bars 75 are operated to close the clamps 26 (FIG. 3) and the threads are drawn to the associated warping apparatus in a manner known to those skilled in the art. In this threaded condition, each thread sensing member 53 gently bears against the thread 12 in the thread guide region 24, preventing further pivotal movement of the drop wire and thus maintaining the contact 80 out of engagement with the switching device 79. This operational state of the switching device 79 thus denotes that the thread associated with the particular assembly 10 is properly inserted and tensioned for a beaming operation.

The clamping force of the clamp 26 is chosen to exert sliding frictional contact of each thread 12 between the thread clamping section 57 and the confronting surface of the inner plate 19, thus imparting a drag tension on the threads being pulled along the paths 14 toward the warping apparatus. This drag tension is sufficient to maintain the threads taut on the paths 14. The warping apparatus then is started at an initially slow speed while the clamps 26 remain closed and the process is observed for proper operation. As the speed of the warping apparatus is increased, the thread clamps 26 of the assemblies 10 normally are moved to the open position shown in FIG. 4, because the unwinding resistance of the thread packages and the air friction acting on the rapidly moving threads will maintain sufficient tension in the thread 12 to keep the threads apart and hold each thread sensing member 53 in the position shown in FIG. 4.

Figure 5:
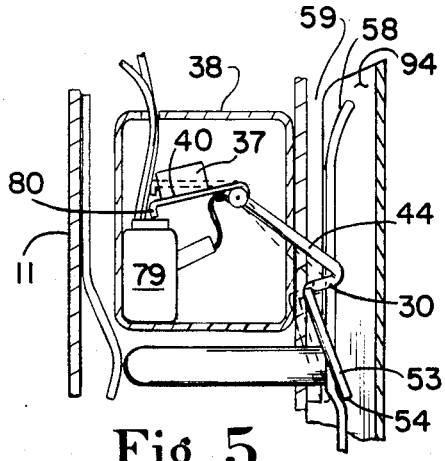
FIG. 5 is a fragmentary side section view as in FIGS. 3 and 4, showing in solid line the drop wire displaced in response to the absence of a thread in the thread guide region, and showing in broken line the same drop wire pivoted to an intermediate operating position.

If a particular thread 12 breaks during the warping operation, the absence of the thread is immediately detected as the thread sensing member 53 pivots out and moves across the thread guide region 24 to the solid-line position shown in FIG. 5, at the urging of the counterweight 37. The contact 80 thus engages the switching device 79, which through appropriate control apparatus known to the art can stop the warping operation and immediately return all the thread clamps 26 to the clamping position shown in FIG. 3. With this action, all the remaining unbroken threads are clamped in place in the assemblies 10, keeping these threads in tension until the broken thread is fixed and the warping operation again begins.

Returning to FIG. 1 and the lower assembly 10A shown therein, a detent stop 84 optionally can be mounted on the outer surface of the face plate 16, immediately to the left of the position taken by the thread sensing member 53 in its normal thread-contacting position. The thread sensing member 53 normally contacts the detent stop, if present. However, the drop wire 31 can be manually pivoted back to move the thread sensing member 53 over and behind the detent stop 84, thereby holding that particular thread sensing assembly in a standby position. This standby position normally would be engaged in warp beaming operations utilizing less than all thread package positions available on a particular creel.

The tension and clamping assembly 10 thus defines a relatively small thread guide region 24, and this region helps limit the lateral oscillation of the thread when running through the assembly at high beaming speeds. In particular, the thread retaining member 49 of the drop wire 31 and the upper surface of the clamp actuating pin 29 provide upper and lower limits for thread oscillation in the vertical plane. However, this arrangement still permits straight-in insertion of the threads through the throat 59 and the aligned thread entry slot 45, because the thread contacts the deflecting member 44 and displaces the thread retaining member 49 without interrupting the straight path of the thread entry slot.

The drop wire 31, although biased toward the thread by the counterweight 37, can alternatively be biased by other means. For example, a spring of force and location chosen to produce the appropriate biasing torque on the drop wire can be substituted for the counterweight 37.

It should be understood that the foregoing relates only to a preferred embodiment of the present invention, and that numerous modifications and changes therein may be made without departing from the spirit and scope of the invention as defined in the following claims.

We claim:

1. Apparatus for clamping and detecting breakage of a tensioned thread, comprising:

support means having a surface extending adjacent to a predetermined path of thread travel;

clamp means mounted in closely spaced relation to said surface with said thread path located between the surface and the clamp means;

means operatively associated with said clamp means to selectably move the clamp means toward said surface and thereby clamp a thread disposed in said path of travel;

a sensing member mounted alongside said surface and operative to move on a path crossing said path of thread travel;

means biasing said sensing member to move across the path of thread travel;

means operatively engaging said sensing member and selectively displacable by a thread being introduced to the thread travel path through the space between said clamp means and said surface, said displacement being operative to deflect the sensing member in opposition to said biasing means and thereby permit the thread to enter said space, so that the sensing member is thereafter deflected by predetermined tension maintained in said thread; and means responsive to said sensing member and operative to signal when the sensing member moves across the path of thread travel, so as to indicate the absence of a thread in the thread path.

2. Apparatus for detecting breakage of threads, comprising:

means defining a thread travel path laterally bounded to partially define the lateral limits of the path, and open on a side to permit inserting a thread into the path;

a thread sensing member mounted alongside said means and operative to move on a path crossing said defined path of thread travel;

said thread sensing member being selectably operative to block said open side and thereby prevent a thread from leaving the path;

means biasing said thread sensing member to contact a thread disposed on the path of thread travel;

deflecting means operatively connected to said thread sensing member and positioned for engagement by a thread being inserted into the thread travel path through said open side, so as to deflect the thread sensing member in opposition to said biasing means and thereby permit the thread to enter said travel path; and said thread sensing member being contacted by a thread in the thread path and being deflected in opposition to said biasing means by predetermined tension maintained in the thread, so that the breakage or other absence of thread in the thread path is indicated by the position of the thread sensing member.

3. Apparatus as in claim 2, further comprising:

signal means responsive to the position of said thread sensing member to produce a certain signal only when the biasing means moves the sensing member across the thread path in response to the absence of a tensioned thread in the thread path.

4. Apparatus for detecting breakage of threads, comprising:

means defining a thread travel path laterally bounded to partially define lateral limits of the path, and open on a side to permit inserting a thread into the path;

a sensing member mounted alongside said means and operative to move on a sensing path crossing said path of thread travel;

means biasing said sensing member to move across the path of thread travel;

said sensing member having a first means extending across said thread path to close said open side, so as to retain a thread in the thread path; and said sensing member having a second means at said open side for engagement and displacement by a thread being inserted through said open side and operative in response to said engagement and displacement to deflect the sensing member in opposition to said biasing means, thereby displacing said first means from the open side and permitting the thread to enter the thread travel path, whereby the biasing means then returns the sensing member to a thread sensing position where the sensing member bears on a thread present in the path, thereby sensing the presence of such thread, and the first means prevents thread withdrawal through the open side of the path.

5. Apparatus as in claim 4, further comprising:

sensing means operatively associated with said sensing member to produce a thread breakage signal, when in the absence of a thread in the thread path, the biasing means moves the sensing member beyond said thread sensing position.

6. Apparatus as in claim 4, wherein said sensing member comprises:

a trip wire mounted for pivotable movement on said sensing path crossing said path of thread travel;

said trip wire having a thread retaining portion comprising said first means and extending across the open side of the thread travel path at spaced apart relation to the pivotable mount of the trip wire; and said trip wire also having a thread operative portion comprising said second means and angularly disposed to pivot the trip wire on said sensing path in response to thread engagement, so that a thread can be placed in the thread travel path by engaging the thread operative portion and then moving through the open side of the path.

7. Apparatus as in claim 6 wherein:

said thread retaining portion meets said thread operative portion at an acute angle forming a knee bend extending across said open side of the thread travel path, whereby the thread must be moved around said knee bend in order to enter the thread travel path.

8. Apparatus as in claim 4, further comprising:

thread guide means located at said open side of the thread travel path to engage a thread entering the open side and define a thread entry path which is blocked by said first means extending across said thread entry path, so that the thread contacts said second means and deflects the sensing member to enter said thread path, as the thread is moved through the thread entry path.

9. Apparatus as in claim 8, wherein:

said guide means has a straight surface portion defining said thread entry path and extending substantially contiguous to a lateral limit of the thread travel path, and leading to said open side; and said guide means further has a throat surface portion leading to said straight surface portion and aligned to extend outwardly therefrom, so as to define a throat region for receiving a thread and guiding the thread into said entry path leading to the thread travel path.

10. Apparatus as in claim 6, further comprising:

thread guide means located at said open side of the thread travel path and including means for selective engagement by said trip wire moving on said sensing path;

said thread guide means having means operative to engage a thread entering said open side and to define a thread entry path which is blocked by said thread retaining portion of the trip wire; and said thread operative portion being located in said thread entry path for engagement by a thread entering that path, so as to deflect said trip wire and permit the thread to enter the thread travel path.

11. Apparatus as in claim 10, further comprising:

sensing means operatively associated with said trip wire to produce a signal indicating thread breakage when the trip wire moves beyond the thread sensing position.

12. Apparatus for detecting thread tension and for clamping a thread running through the apparatus, comprising:

support means having a first thread clamping surface facing a predetermined path of running travel for the thread;

thread guide means operatively associated with said support means and defining a thread entry path leading to said travel path, for placing a thread therein;

a sensing member mounted on said support means for movement on a sensing path which crosses said thread travel path and contacts a thread present in the thread travel path, said sensing member normally operative to move across the thread travel path and being restrained from crossing said path by contact with a tensioned thread extending therealong;

clamp means associated with said support means and having a second thread clamping surface in opposed and closely spaced apart relation to said first thread clamping surface and in noncontacting relation to said sensing member, said first and second thread clamping surfaces being on opposed sides of said thread travel path;

clamp actuating means selectably operative to move said clamp means either to an open position mutually spacing apart said thread clamping surfaces and thus permitting the thread to move freely along said path of travel, or to a closed position whereat the first and second thread clamping surfaces are mutually contacting and the thread is frictionally engaged between said clamping surfaces;

said sensing member having a first means extending across said thread travel path and obstructing said thread entry path so as to retain a thread previously placed therein;

said sensing member having a second means extending across said thread entry path for contacting a thread entering said thread entry path and movably displacing the sensing member and said first means in response to such contact and thread entry, so that the thread can be placed in the thread travel path and will thereafter be retained therein by said first means; and sensing means operatively associated with said sensing member to provide a signal indicating thread breakage only whenever the sensing member moves across the thread travel path.

* * * * *